US009495861B2

(12) United States Patent
Eskildsen et al.

(10) Patent No.: US 9,495,861 B2
(45) Date of Patent: Nov. 15, 2016

(54) SYSTEM AND METHOD FOR TAKE-OVER PROTECTION FOR A SECURITY SYSTEM

(71) Applicant: Honeywell International Inc., Morristown, NJ (US)

(72) Inventors: Kenneth G. Eskildsen, Great Neck, NY (US); Mark Douglas Okeefe, San Diego, CA (US); Doug Marshall, Sugarland, TX (US)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 28 days.

(21) Appl. No.: 14/557,733

(22) Filed: Dec. 2, 2014

(65) Prior Publication Data

US 2016/0155319 A1 Jun. 2, 2016

(51) Int. Cl.

| | |
|---|---|
| ***G08B 1/08*** | (2006.01) |
| ***G08B 25/14*** | (2006.01) |
| ***G08B 25/00*** | (2006.01) |
| ***G08B 25/10*** | (2006.01) |

(52) U.S. Cl.

CPC ..... *G08B 25/14* (2013.01); *G08B 25/003* (2013.01); *G08B 25/008* (2013.01); *G08B 25/10* (2013.01); *G08B 25/007* (2013.01)

(58) Field of Classification Search

CPC ..... G08B 25/03; H04L 63/02
USPC ..... 340/539.19, 541, 545.1, 545.2, 545.9, 340/3.1, 3.3, 3.32, 506; 726/19
See application file for complete search history.

(56) References Cited

U.S. PATENT DOCUMENTS

| | | | | |
|---|---|---|---|---|
| 5,907,279 | A | 5/1999 | Bruins et al. | |
| 7,728,724 | B1 | 6/2010 | Scalisi et al. | |
| 8,086,702 | B2 * | 12/2011 | Baum | H04L 12/2803 709/219 |
| 8,086,703 | B2 * | 12/2011 | Baum | H04L 12/2809 709/219 |
| 8,122,131 | B2 * | 2/2012 | Baum | H04L 12/2809 709/219 |
| 8,456,278 | B1 | 6/2013 | Bergman et al. | |
| 8,638,210 | B2 * | 1/2014 | Simon | G08B 29/16 340/506 |
| 8,996,665 | B2 * | 3/2015 | Baum | H04L 12/2809 709/220 |
| 2013/0009775 | A1 | 1/2013 | Egawa | |
| 2015/0334087 | A1 * | 11/2015 | Dawes | H04L 63/02 726/12 |

OTHER PUBLICATIONS

Extended European search report from corresponding EP patent application 15195744.6, dated Feb. 5, 2016.

* cited by examiner

*Primary Examiner* — Toan N Pham
(74) *Attorney, Agent, or Firm* — Husch Blackwell LLP

(57) ABSTRACT

A secure communications and monitoring system includes a control unit and a plurality of modules distributed in a region to be monitored. The control unit has an assigned identifier. When a module is installed in the system, the control unit transmits the identifier to the module, which stores the identifier. Before a module communicates with the control unit, the identifier is requested from the control unit. The identifier received from the control unit is compared to the stored identifier. The module will only communicate with the control unit where the identifier received at the module corresponds to the identifier stored at the module.

16 Claims, 2 Drawing Sheets

SYSTEM AND METHOD FOR TAKE-OVER PROTECTION FOR A SECURITY SYSTEM

FIELD

The application pertains to regional monitoring or control systems. More particularly, the application pertains to security or ambient condition monitoring systems, wherein system components, detectors, or control elements limit their communications to known or pre-determined system control units.

BACKGROUND

Security dealers provide security systems to protect people's lives and property. There are various segments to the security business market ranging from high end installations to basic, low-cost solutions. The basic, low-cost solution is usually offered to the consumer at a cost lower than the cost of the security equipment with the expectation that the cost will be recovered via a monthly monitoring fee. Problems arise when a competing security dealer offers the consumer a lower monthly monitoring fee and "takes over" the installed security equipment.

"Taking over" a security system saves the competitor the time and expense of installing the security system. The process of "taking over" a security system involves removing the existing control panel, installing a new control panel, and configuring the control panel to accept signals from the existing security sensors. Hence, the savings are realized by the reuse of the existing sensors that were provided by the original security dealer.

DETAILED DESCRIPTION

Figure 1:
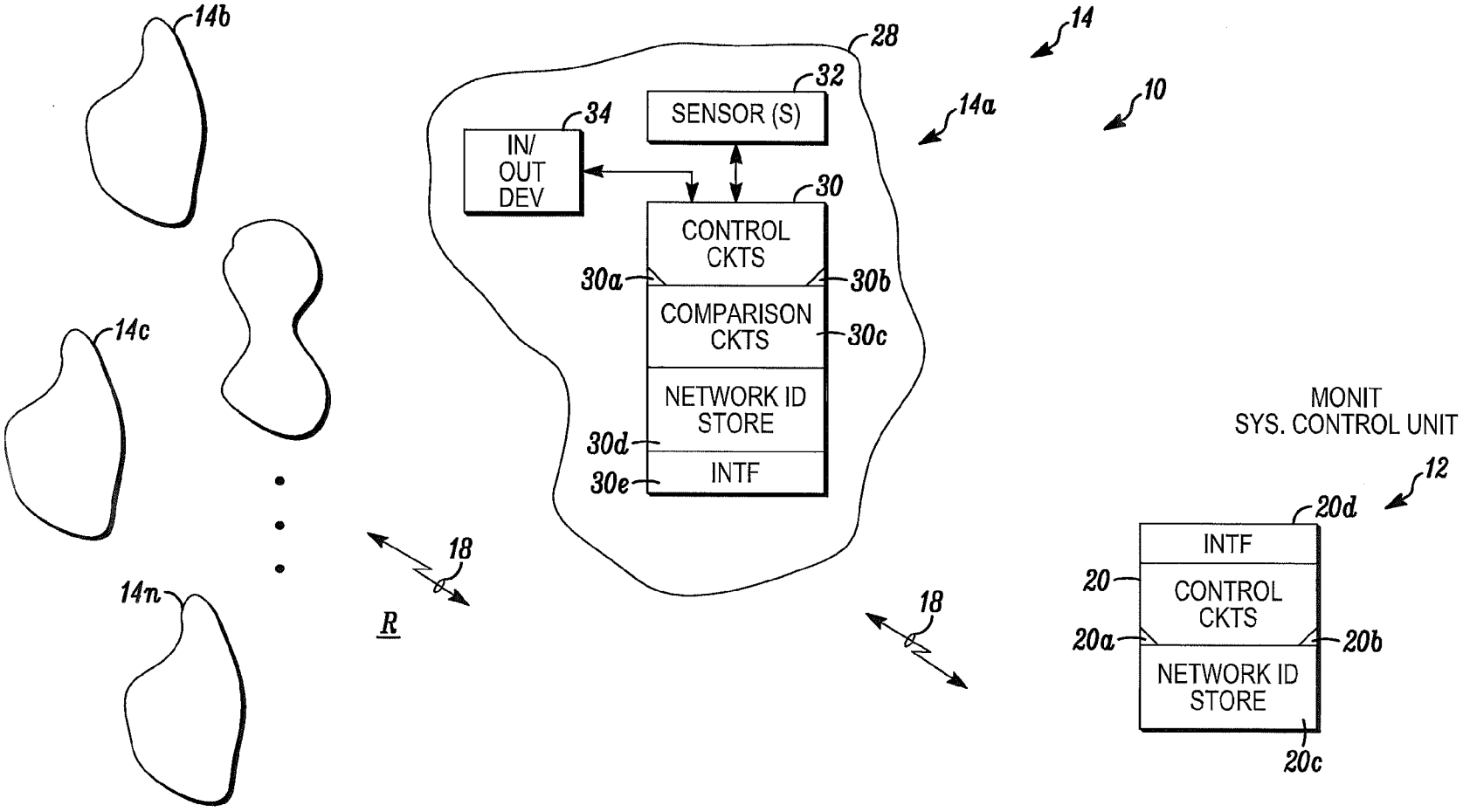
FIG. 1 is a block diagram of a system in accordance herewith.

While disclosed embodiments can take many different forms, specific embodiments hereof are shown in the drawings and will be described herein in detail with the understanding that the present disclosure is to be considered as an exemplification of the principles hereof, as well as the best mode of practicing the same, and is not intended to limit the claims hereof to the specific embodiment illustrated.

In embodiments hereof, the problem is solved by pairing members of a plurality of system modules, such as security sensors, control elements, or ambient condition detectors, with a system control panel or system control circuits. In a disclosed embodiment, the modules, for example, the sensors, control elements, or detectors, without limitation, will only communicate with the system control circuits provided by the security dealer that installed the entire system.

Should a competing dealer try to "take over" the system by removing the control circuits or panel, the existing modules, whether they be implemented as sensors, ambient condition detectors, or control elements, will not communicate with the new control system or panel. Therefore, the entire system (panel and modules) will need to be replaced to take over the system.

In one aspect hereof, only an authorized user can remove a sensor, detector, or peripheral from the security system and reuse the removed module with a different security system.

An authorized user can be the dealer, installer, or other person assigned by the dealer (perhaps the end user). There are many ways to determine if a user is "authorized", such as the use of an authorized user code, biometric identifier, password, etc. Once the user is authenticated, the removal and reuse of the respective module is permitted.

In a disclosed embodiment, two-way RF modules are coupled to an integral RF modular network identifier (ID). The network ID is derived from, for example, a MAC address, that is stored in the control panel. This MAC address is unique to the control panel and in the domain of MAC addresses. Other identifiers can be used without departing from the spirit and scope hereof.

When a module is enrolled into the control panel, the control panel provides the network ID to that module. The network ID is stored in non-volatile memory in the module. Whenever the module communicates with the control panel, the module verifies the network ID of the panel. If the received ID does not match the pre-stored ID, then the module will cease communications with that panel.

FIG. 1 illustrates a monitoring system 10 that has a local control unit 12. A plurality of modules 14 can be in bidirectional wired or wireless RF communications with the control unit 12. Members of the plurality 14, such as 14*a*, 14*b* . . . 14*n*, can be installed throughout a region R of interest. Members of the plurality 14 can include, without limitation, motion detectors, position detectors, glass break detectors, smoke detectors, flame detectors, gas detectors, thermal detectors, door access control modules, and authorizing modules.

The control unit 12 and members 14*a*, 14*b* . . . 14*n* of the plurality of modules 14 can be in bidirectional communication as would be understood by those of skill in the art. The communications medium 18 can be wired or wireless, without limitation.

The control unit, or panel 12 can include control circuits 20 that can be implemented, at least in part, with one or more programmable processors 20*a* and associated executable control software or instructions 20*b*.

A unique network identifier 20*c* can be assigned to the system 10 and stored in non-volatile storage 20*c*. An input/output wired or wireless interface 20*d* can also be coupled to the control circuits 20.

The module 14*a* is representative of the members of the plurality 14. A discussion of module 14*a* will also suffice for a discussion of the remaining members of the plurality 14.

The module 14*a* includes a housing 28, which can be mounted to a wall, ceiling, floor, or the like, without limitation, depending on the characteristic thereof. The particular mounting arrangement is not a limitation hereof.

The housing 28 can carry control circuits 30, which can be implemented, at least in part, with one or more programmable processors 30*a* in combination with pre-stored, executable control instructions 30*b*. The control circuits 30 are coupled to comparison circuits 30*c* and to a non-volatile network identification storage unit 30*d*. The control circuits 30 are also coupled to a wired or wireless communications interface 30*e* to implement bidirectional communications with the unit 12 via the medium 18.

The control circuits 30 are also coupled to one or more sensors 32 and/or one or more input/output devices 34. The devices 32, 34 can be selected from a class which includes at least motion detectors, position detectors, glass break detectors, smoke detectors, flame detectors, gas detectors, thermal detectors, door access control modules, solenoid modules, and authorizing modules, all without limitation.

Figure 2:
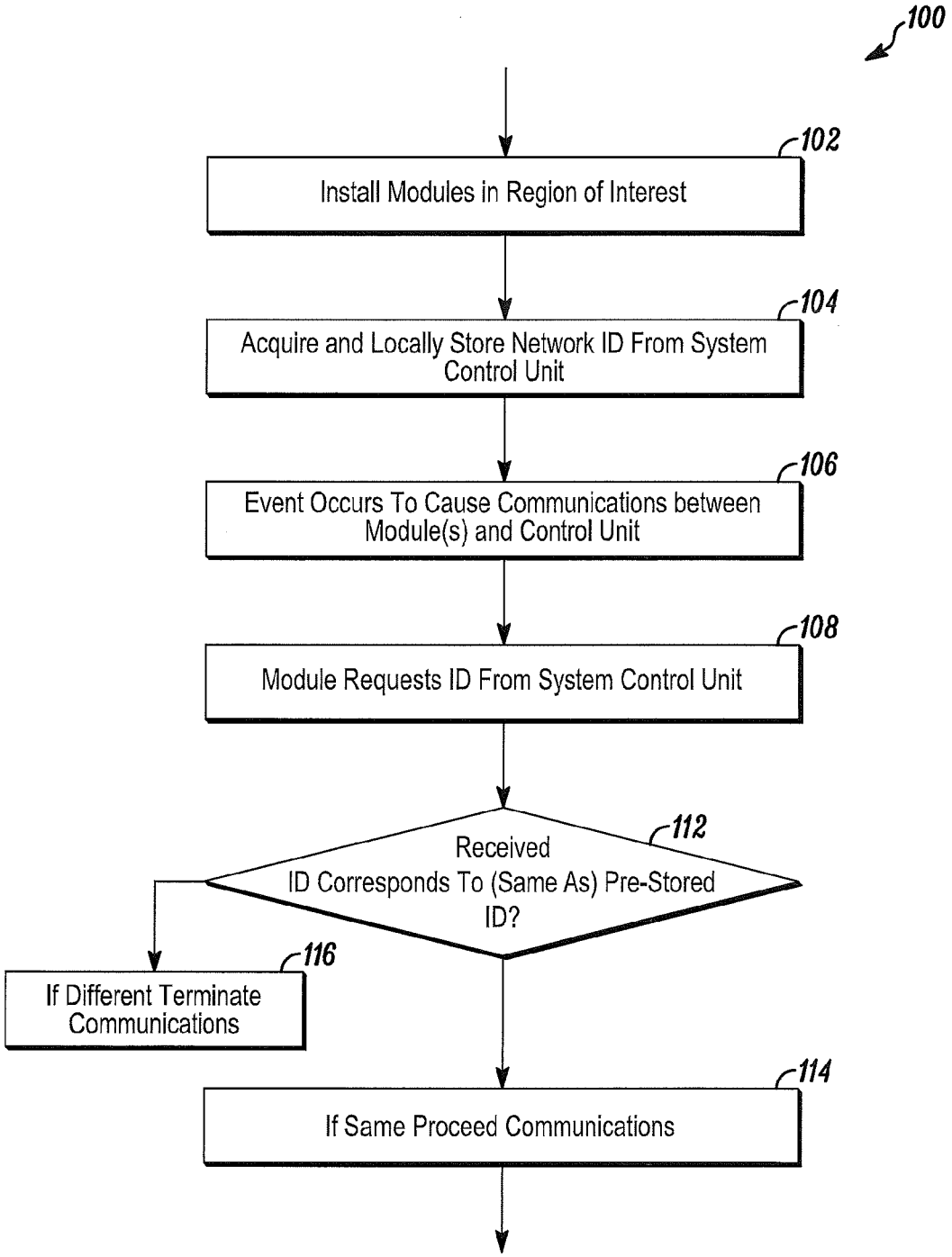
FIG. 2 is a flow diagram in accordance herewith.

FIG. 2 illustrates aspects of a method 100 of operating the system 10. The various modules 14 can be initially installed in a region R as required, as at 102. The method 100 is representative of processing in connection with a group of modules 14 in an initial system installation or replacement of a single module after installation.

Each of the modules 14 acquires and locally stores a network identifier obtained from the control unit 12 and stored locally at the unit 30*c*, as at 104. When an event occurs that causes communications to occur between one more members of the plurality 14 and the control unit 12, as at 106, each respective module requests that the control unit 12 transmit a copy of the system identifier stored, for example, at the storage element 20*c*, as at 108.

The system identifier received at the module 14*a* from the control unit 12 is compared to the pre-stored identifier at 30*d* using the comparison circuits 30*c*, as at 112. If the pre-stored identifier from the unit 30*c* corresponds to or is the same as the received identifier, as at 112, then the communications proceed, as at 114. If not, then communications are either not initiated or terminated, as at 116. It will be understood that neither the details as to how the pre-stored identifier is represented at the unit 14*a* nor the exact details of the comparison with the pre-stored identifier and the received identifier are limitations hereof.

As those of skill in the art will understand, there will be various ways for the installer to manage the network ID so that sensors can be removed, replaced, or repurposed. However, this capability will only be available via secure communications by the dealer that installed the equipment.

Alternate methods may achieve the goal of pairing a module or sensor with a security system and only allowing authorized users to repurpose a sensor. Such other systems or methods that achieve the same result come within the spirit and scope hereof.

In summary, the sensors or detectors are manufactured in a default state. This state enables the sensor to be enrolled with any compatible security system. Once the sensor has been enrolled with a panel, the sensor is no longer in the default state and will only work with the panel with which the sensor has been enrolled. To repurpose, that is, to enroll the sensor with a different panel, the sensor will need to be reset to the default state. Only authorized users can reset the sensor into the default state.

During implementation, for example, during the first 24 hours after enrollment, the enrolled sensors can be defaulted at the system control panel by anyone, not just an authorized user. This feature provides a way to deal with enrollment mistakes, such as when a sensor is enrolled with the wrong control panel.

Panel replacement, for example, if the control panel malfunctions and needs to be replaced, is a process available for an authorized user to replace the control panel, and all of the sensors will change their allegiance to the new panel.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

Further, logic flows depicted in the figures do not require the particular order shown or sequential order to achieve desirable results. Other steps may be provided, or steps may be eliminated from the described flows, and other components may be added to or removed from the described embodiments.

The invention claimed is:

1. A method comprising:

establishing a system and providing a plurality of modules in the system each of which communicates with a monitoring system control panel:

providing a control panel identifier that is made available to at least some of the plurality of modules:

storing the control panel identifier in non-volatile storage at the at least some of the plurality of modules;

requesting, by at least one of the plurality of modules, that the monitoring system control panel communicate the control panel identifier to the at least one of the plurality of modules:

receiving, by the at least one of the plurality of modules, the control panel identifier and comparing the control panel identifier received by the at least one of the plurality of modules with the control panel identifier stored in the at least one of the plurality of modules; and initiating communications with the monitoring system control panel only if the control panel identifier received by the at least one of the plurality of modules matches the control panel identifier stored in the at least one of the plurality of modules.

2. A method as in claim 1 that includes providing a plurality of ambient condition detectors, and evaluating the control panel identifier at the plurality of ambient condition detectors before initiating communications with the monitoring system control panel.

3. A method as in claim 1 that includes providing the non-volatile storage at each of the plurality of modules.

4. A method as in claim 3 that includes providing wireless communications between the at least some of the plurality of modules and the monitoring system control panel.

5. A method as in claim 4 that includes selecting the plurality of modules from a class that includes at least motion detectors, position detectors, glass break detectors, smoke detectors, flame detectors, gas detectors, thermal detectors, door access control modules, and authorizing modules.

6. A method as in claim 5 that includes providing wireless transceivers in the at least some of the plurality of modules and in the monitoring system control panel.

7. An apparatus comprising:

a communications system having a plurality of modules each of which communicates with a system control unit:

a predetermined identifier associated with the system control unit;

a storage element at each of the plurality of modules; and circuitry at the system control unit to send the predetermined identifier to each of the plurality of modules for storage in the storage element, wherein each of the plurality of modules requests the predetermined identifier from the system control unit prior to communicating with the system control unit, wherein each of the plurality of modules includes circuitry to compare a received, requested identifier to an identifier pre-stored in a respective one of the plurality of modules, and wherein subsequent communications with the system control unit are not initiated where the received, requested identifier differs from the identifier pre-stored in the respective one of the plurality of modules.

8. An apparatus as in claim 7 wherein members of the plurality of modules are selected from a class that includes, at least, motion detectors, position detectors, glass break detectors, smoke detectors, flame detectors, gas detectors, thermal detectors, door access control modules, and authorizing modules.

9. An apparatus as in claim 7 wherein the communications system comprises a regional monitoring system, and wherein the predetermined identifier is associated with the system control unit.

10. An apparatus as in claim 9 wherein the plurality of modules of the communications system will not communicate with the control unit that has a control unit identifier different from the identifier pre-stored in the respective one of the plurality of modules.

11. An apparatus as in claim 7 wherein the communications system is selected from a class that includes at least a heating ventilating and air conditioning system, a fire detection system, a gas detection system, or a security monitoring system.

12. An apparatus as in claim 11 wherein at least some of the plurality of modules communicate wirelessly with the system control unit.

13. A secure communications and monitoring system comprising:

a control unit and a plurality of modules in wireless communication with one another, wherein the control unit has an assigned identifier, and, when one of the plurality of modules is installed in the secure communications and monitoring system, the control unit transmits the assigned identifier to the one of the plurality of modules, and the one of the plurality of modules stores the assigned identifier, wherein, before the one of the plurality of modules communicates with the control unit, the assigned identifier is requested from the control unit by the one of the plurality of modules, and the assigned identifier received from the control unit is compared to a stored identifier at the one of the plurality of modules, and wherein the one of the plurality of modules only communicates with the control unit when the assigned identifier received at the one of the plurality of modules corresponds to the stored identifier.

14. A system as in claim 13 that includes comparison circuitry to compare the stored identifier to the assigned identifier received from the control unit.

15. A method comprising:

providing a plurality of detectors, wherein members of the plurality of detectors are enrolled with a compatible security system, wherein the members of the plurality of detectors exhibit a default state before enrollment with the compatible security system, wherein, once one of the plurality of detectors has been enrolled with the compatible security system, the one of the plurality of detectors exhibits a different, non-default state such that the one of the plurality of detectors only operates with the compatible security system with which the one of the plurality of detectors has been enrolled and only communicates with a first control panel of the compatible security system with which the one of the plurality of detectors has been enrolled, wherein enrolling the one of the plurality of detectors with a second control panel requires resetting the one of the plurality of detectors to the default state, and wherein each of the plurality of detectors exhibiting the different, non-default state requests a control panel identifier from the first control panel that is compared with a pre-stored identifier and communicates with the first control panel only when the control panel identifier matches the pre-stored identifier.

16. A method as in claim 15 including providing at least one authorized user who can reset the plurality of detectors to the default state.

* * * * *